US010107507B2

(12) United States Patent
Cho et al.

(10) Patent No.: US 10,107,507 B2
(45) Date of Patent: Oct. 23, 2018

(54) OUTDOOR UNIT OF AIR CONDITIONER

(71) Applicant: LG ELECTRONICS INC., Seoul (KR)

(72) Inventors: Namjoon Cho, Seoul (KR); Dongkeun Yang, Seoul (KR); Hyoungsuk Woo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 193 days.

(21) Appl. No.: 15/070,890

(22) Filed: Mar. 15, 2016

(65) Prior Publication Data

US 2016/0273788 A1 Sep. 22, 2016

(30) Foreign Application Priority Data

Mar. 16, 2015 (KR) ..... 10-2015-0036068

(51) Int. Cl.

| | |
|---|---|
| ***F24F 1/40*** | (2011.01) |
| ***F24F 1/38*** | (2011.01) |
| ***F24F 1/50*** | (2011.01) |
| ***F24F 1/56*** | (2011.01) |

(52) U.S. Cl.

CPC ..... *F24F 1/40* (2013.01); *F24F 1/38* (2013.01); *F24F 1/50* (2013.01); *F24F 1/56* (2013.01)

(58) Field of Classification Search

CPC ..... F24F 13/082; F24F 1/56; F24F 1/0022; F24F 1/38; F24F 1/50; F24F 1/40

See application file for complete search history.

(56) References Cited

U.S. PATENT DOCUMENTS 4,723,419 A * 2/1988 Kessler ..... F24F 1/38 165/145

2014/0357180 A1 12/2014 Kim

FOREIGN PATENT DOCUMENTS

| | | | |
|---|---|---|---|
| CN | 1106522 | A | 8/1995 |
| CN | 1389672 | A | 1/2003 |
| CN | 101086349 | A | 12/2007 |
| CN | 101351676 | A | 1/2009 |
| CN | 202734092 | U | 2/2013 |
| EP | 1 120 571 | A1 | 8/2001 |
| EP | 1 391 661 | A1 | 2/2004 |
| EP | 2 246 635 | A1 | 11/2010 |
| JP | 2008-138896 | A | 6/2008 |
| JP | 2009-63186 | A | 3/2009 |
| KR | 10-1999-0009430 | A | 2/1999 |

(Continued)

*Primary Examiner* — Cassey D Bauer
(74) *Attorney, Agent, or Firm* — Dentons US LLP

(57) ABSTRACT

The present disclosure relates to an outdoor unit of an air conditioner, the outdoor unit including a case forming a front surface and a rear surface and an exterior of a circumferential surface between the front surface and the rear surface and divided into a mechanical room and a heat exchange space by a barrier, a blower fan disposed in the heat exchange space to suction in air in an axial direction and discharge air in a circumferential direction, an outdoor heat exchanger disposed in the heat exchange space, an orifice member disposed to divide the blower fan and the outdoor heat exchanger and guide heat exchanged air toward the blower fan, and discharge grilles formed at a portion of the circumferential surface including an upper surface of the case and having outlets to allow the heat-exchanged air to be discharged in the circumferential direction.

17 Claims, 8 Drawing Sheets

(56) References Cited

FOREIGN PATENT DOCUMENTS

| | | | |
|---|---|---|---|
| KR | 10-2001-0080037 | B1 | 8/2001 |
| KR | 10-2001-0104466 | A | 11/2001 |
| KR | 10-0408781 | B1 | 12/2003 |
| KR | 10-0772236 | B1 | 11/2007 |
| KR | 10-0838861 | B1 | 6/2008 |
| WO | 2007/078287 | A1 | 7/2007 |

* cited by examiner

OUTDOOR UNIT OF AIR CONDITIONER

CROSS-REFERENCE TO RELATED APPLICATION(S)

The application claims priority under 35 U.S.C. § 119 and 35 U.S.C. § 365 to Korean Patent Application No. 10-2015-0036068, filed Mar. 16, 2015, which is hereby incorporated by reference.

BACKGROUND

1. Field

The present disclosure relates to an outdoor unit of an air conditioner.

2. Background

An air conditioner is a home appliance used for maintaining indoor air at a desired temperature. For example, an air conditioner may cool or warm indoor air, and/or adjust an indoor humidity level. The air conditioner performs such cooling or heating operations by a refrigeration cycle that performs compression, condensation, expansion, and evaporation processes of refrigerant.

Air conditioners may be classified as a split or integrated air conditioner type. The split air condition type has an indoor unit and an outdoor unit that are separated. The integrated air conditioner type has an indoor unit and an outdoor unit that are coupled as a single device. The outdoor unit includes an outdoor heat exchanger that exchanges heat with outdoor air, and the indoor unit includes an indoor heat exchanger that exchanges heat with indoor air.

When the refrigeration cycle performs a cooling operation, the outdoor heat exchanger operates as a condenser, and the indoor heat exchanger operates as an evaporator. Conversely, when the refrigeration cycle performs a heating operation, the indoor heat exchanger operates as a condenser and the outdoor heat exchanger operates as an evaporator.

The outdoor unit of the air conditioner may include a variety of configurations including the outdoor heat exchanger through which refrigerant for heat exchange flows, a compressor for compressing the refrigerant, and a blower fan for a forcible flow of air. The outdoor unit may further include a suction grille through which outside air is introduced into the outdoor unit and a discharge grille through which air heat-exchanged in the outdoor unit is discharged to the outside. The suction grille may be provided at a rear surface of the outdoor unit, the discharge grille may be provided at a front surface of the outdoor unit, and the blower fan may be provided between the suction grille and the discharge grille. As a result, air suctioned through the suction grille is heat-exchanged with refrigerant while passing through the outdoor heat exchanger, and the heat-exchanged air is discharged to the outside through the discharge grille via the blower fan. However, in a case of a general outdoor unit having the above structure, the heat-exchanged hot air is discharged through the front surface of the outdoor unit, which may then be undesirably blown towards pedestrians.

To solve this problem, Japanese Published Patent Application No. 2009-63186 discloses an outdoor unit of an air conditioner having a separate wind direction guide that guides air discharged through the discharge grille to head upward. However, such structure increases wind noise and decreases cooling efficiency.

To solve the above problems, Korean Published Patent Application No. 10-1999-009430 discloses an outdoor unit of an air conditioner having a Sirocco fan inside the outdoor unit, a housing to guide suctioned air upward, and a heat exchanger disposed to surround the housing as well as having a suction grille formed at a front surface and a rear surface thereof and a discharge grille formed at an upper surface thereof, such that the air suctioned through the front and rear surfaces may be discharged upward. In the outdoor unit having the above structure, the discharged air may be discharged upward and the heat-exchanged hot air is discharged upward, thereby not affecting the pedestrians. However, because the suctioning of air occurs through the front and rear surfaces, it is difficult to efficiently utilize space when a plurality of outdoor units are installed and arranged parallel to each other, and heat exchange efficiency is compromised due to the shape and arrangement structure of the heat exchanger.

SUMMARY

An object of the present disclosure is to provide an outdoor unit of an air conditioner that discharges air suctioned through one of a front surface and a rear surface of the outdoor unit in an upward direction, wherein the outdoor unit of the air conditioner has an improved heat exchange efficiency and/or reduced noise compared with conventional air conditioner configurations.

According to an embodiment of the present disclosure, an outdoor unit an air conditioner includes: a case having a mechanical room and a heat exchange space, the case having a front surface, a rear surface, and a circumferential surface disposed between the front and rear surfaces; a blower fan disposed in the heat exchange space to suction in air in an axial direction and discharge the suctioned air in a circumferential direction; an outdoor heat exchanger disposed covering an opening formed in the rear surface, the outdoor heat exchanger providing a heat exchange between the suctioned air and a refrigerant; a plurality of discharge grilles formed at a portion of the circumferential surface, the discharge grilles having a plurality of outlets to discharge the heat-exchanged air in the circumferential direction; and an orifice member that separates the blower fan and the outdoor heat exchanger, wherein the orifice member guides air that passes through the outdoor heat exchanger toward the blower fan and simultaneously guides the air discharged by the blower fan toward the plurality of outlets.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Advantages, features, and methods for achieving those of embodiments may become apparent upon referring to embodiments described later in detail together with the attached drawings. However, embodiments are not limited to the embodiments disclosed hereinafter, but may be embodied in different modes. The same reference numbers may refer to the same elements throughout the specification.

Figure 1:
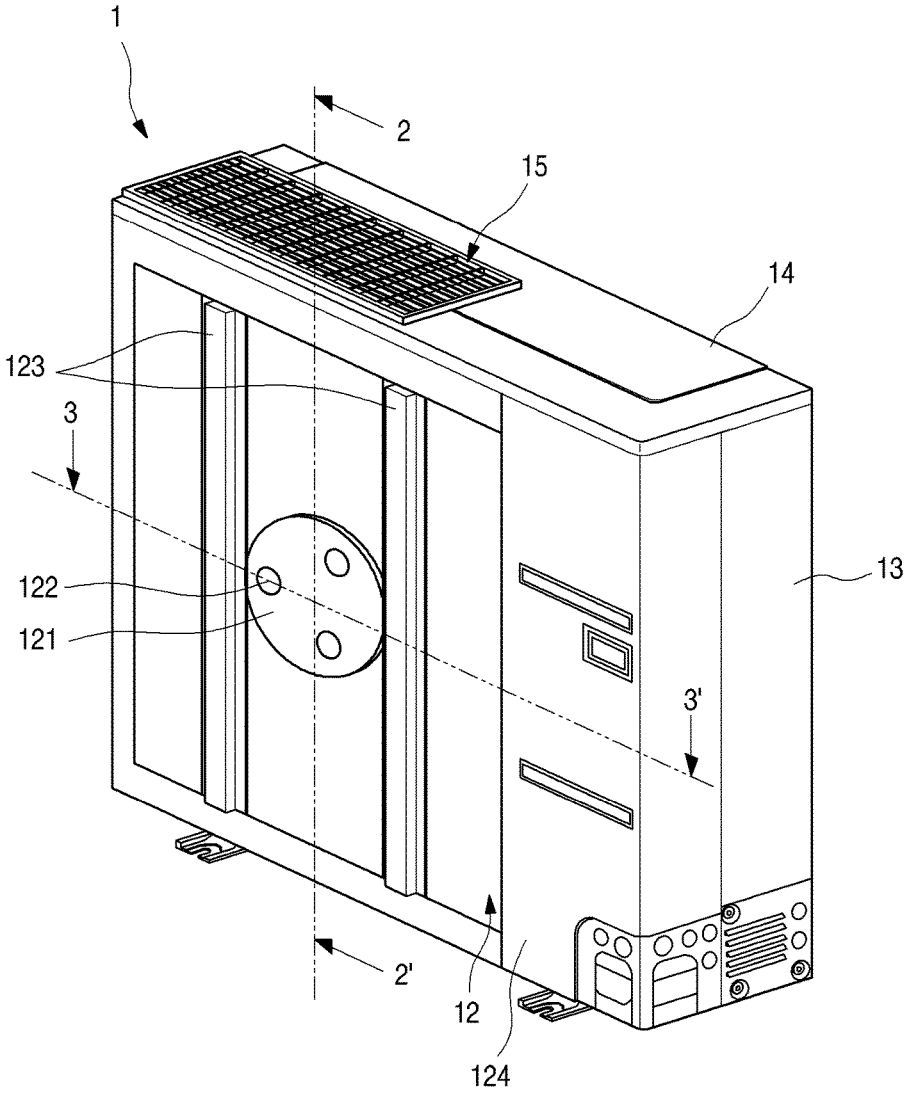
FIG. 1 is a perspective view of an outdoor unit of an air conditioner according to an embodiment of the present disclosure.
Figure 2:
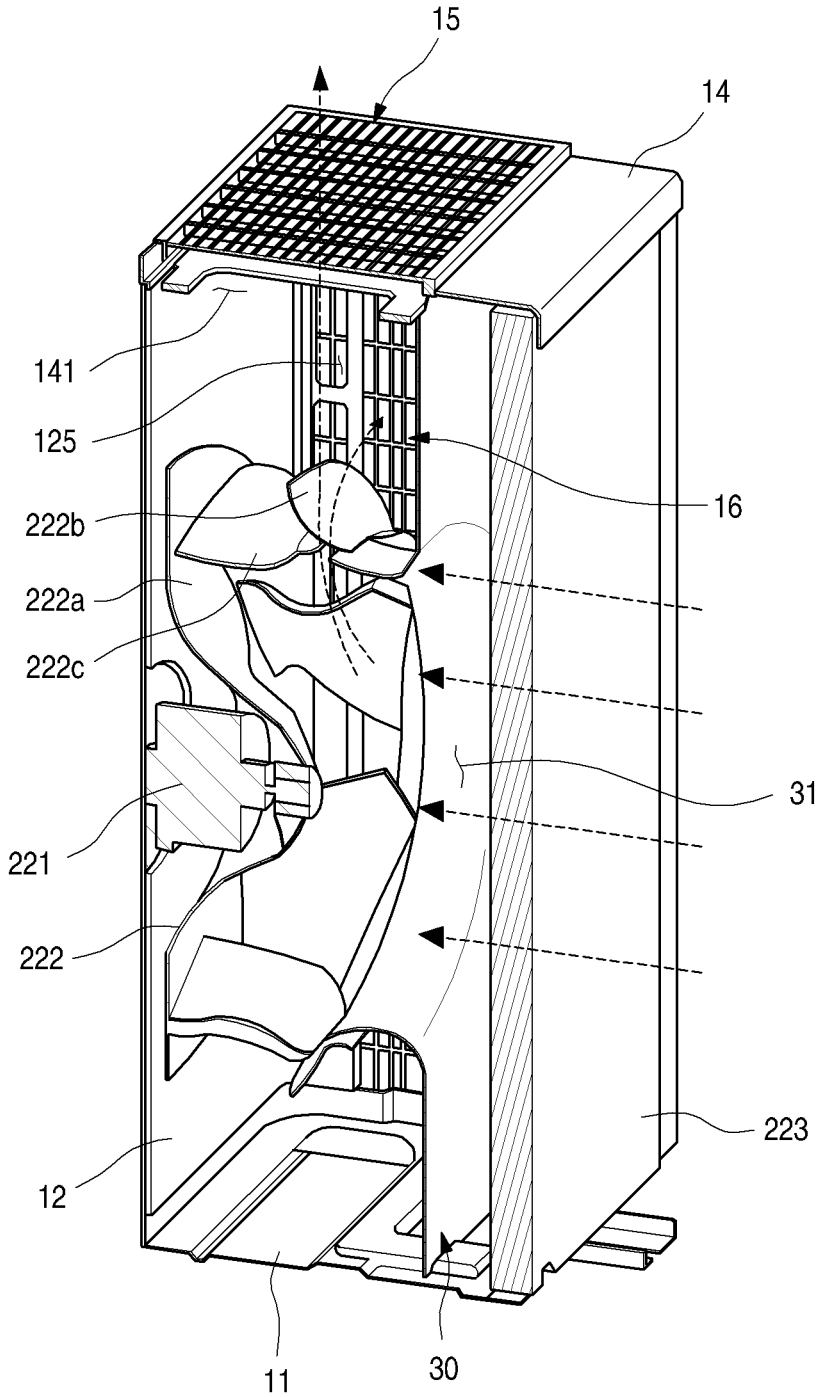
FIG. 2 is a cross-sectional view taken along line 2-2' of FIG. 1.
Figure 3:
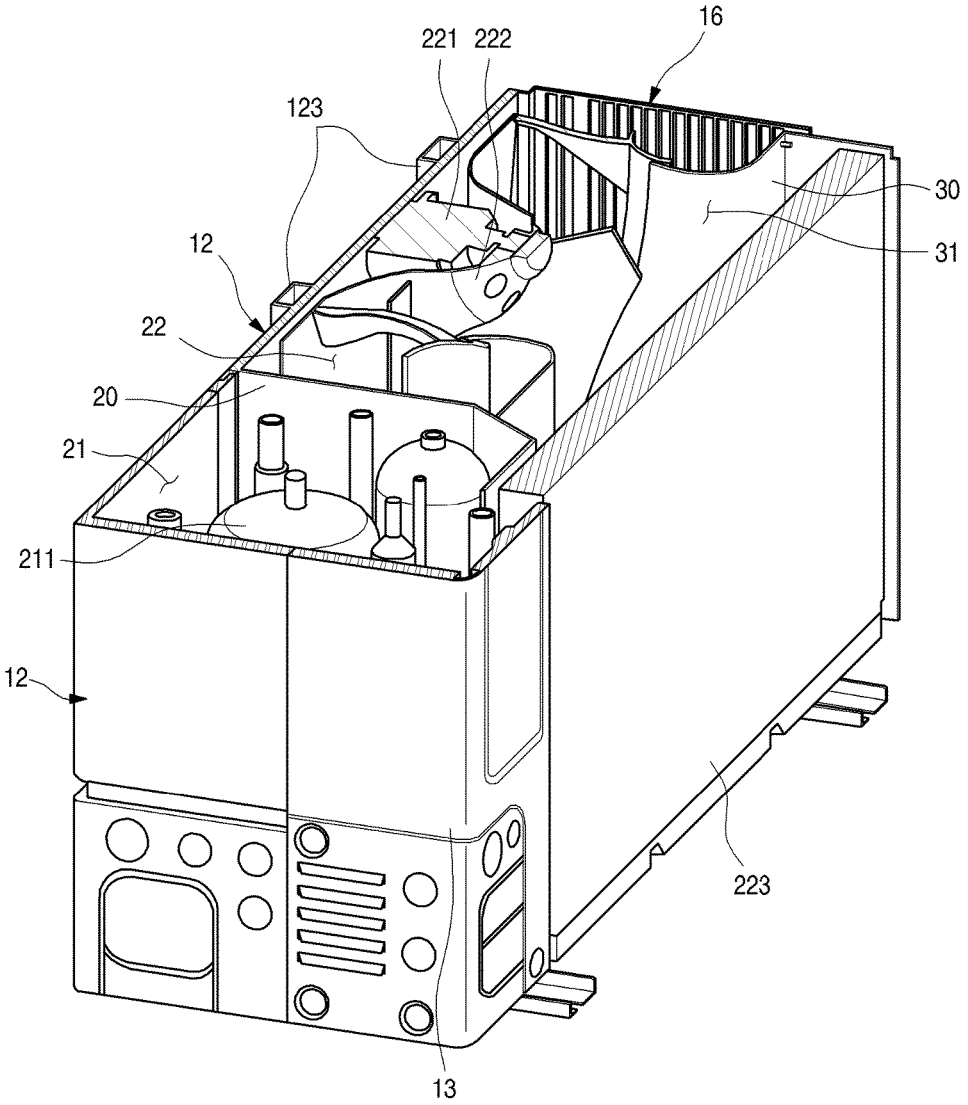
FIG. 3 is a cross-sectional view taken along line 3-3' of FIG. 1.

FIG. 1 is a perspective view of an outdoor unit of an air conditioner according to an embodiment of the present disclosure. FIG. 2 is a cross-sectional view taken along line 2-2' of FIG. 1. FIG. 3 is a cross-sectional view taken along line 3-3' of FIG. 1.

As illustrated in FIGS. 1-3, an exterior of an outdoor unit 1 of an air conditioner according to an embodiment of the present disclosure is formed by a rectangular parallelepiped case. The case include a base pan 11 forming a floor surface of the outdoor unit 1, a top cover 14 forming an upper surface of the outdoor unit 1, a front plate 12 forming a front surface of the outdoor unit 1, and a rear plate 13 forming a rear surface and at least a portion of both side surfaces of the outdoor unit 1. The front plate 12 and the rear plate 13 may be provided between the base pan 11 and the top cover 14 to form an overall exterior shape. The front plate 12 may be formed of a plate-like metal material, but is not limited to any particular type of material.

A motor mounting unit 121 may be provided at the front plate 12. The motor mounting unit 121 may be, for example, a part where the fan motor 221 for driving the blower fan 222, which is described below. The motor mounting unit 121 may be mounted and recessed to provide a structure in which the fan motor 221 may be seated.

The front plate 12 may further include reinforcement members 123 to prevent vibration that may occur when the blower fan 222 operates. As shown, the reinforcement members 123 may vertically extend to connect an upper end and a lower end of the front plate 12. The reinforcement members 123 may be formed in the shape of a bar or a polygonal pipe, but is not limited to such shapes. The reinforcement members 123 may be provided at both left and right sides of the fan motor 221, e.g., abutting a position at which the fan motor 221 is mounted. Consequently, movement that occurs when the fan motor 221 operates may be prevented by supporting the front plate 12.

The front plate 12 may also include a separable service plate 124. The service plate 124 allows a partial area of the mechanical room 21 to be opened and closed. As shown, the service plate 124 may form a portion of the front surface and a portion of the side surface of the outdoor unit 1. That is, the service plate 124 may be separated from the front plate 12 so that the inside of the mechanical room 21 is accessible (e.g., for maintenance or service work).

A side opening 125 may be formed at a side surface of the outdoor unit 1 that is formed by the front plate 12, and a side discharge grille 16 may be provided at the side opening 125. The side discharge grille 16 has a plurality of outlets formed to discharge air that is heat-exchanged inside the outdoor unit 1 and may be formed at another side surface that faces the side surface at which the mechanical room 21 is formed.

As shown, the side discharge grille 16 may be provided at a side surface of the outdoor unit 1 and at a side of the blower fan 222. For example, the side discharge grille 16 may be formed at a position that is angled toward the front of the side surface of the outdoor unit 1 corresponding to a position of the blower fan 222, and vertically extend such that air discharged in the circumferential direction of the blower fan 222 may smoothly be discharged through the side discharge grille 16.

As shown, the top cover 14 may be formed at the upper surface of the outdoor unit 1. The top cover 14 may be coupled with upper ends of the front plate 12 and the rear plate 13. The front plate 12 and the rear plate 13 may be coupled together.

A top opening 141 may be provided at the top cover 14. A top discharge grille 15 may be provided at the top opening 141. As shown, the top discharge grille 15 may have a plurality of outlets to discharge the air heat-exchanged in the outdoor unit 1 and guide the air discharged from the inside of the outdoor unit 1 in an upward direction.

The top discharge grille 15 may be formed on an upper surface of the top cover 14 and disposed at a position corresponding to the blower fan 222. Thus, the top discharge grille 15 may be formed at a position that is angled (e.g., slanted) toward the front of the top cover 14. The top discharge grille 15 may be provided at a side end of the upper surface of the outdoor unit 1 that abuts the side discharge grille 16. In other words, the side discharge grille 16 and the top discharge grille 15 may be connected to each other and configured such that air blown by the blower fan 222 is discharged in an upward direction through the top discharge grille 15.

The rear plate 13 may form the rear surface of the outdoor unit 1 and portions of left and right side surfaces of the outdoor unit 1. The rear plate 13 forming the rear surface of the outdoor unit 1 may be formed such that at least a portion thereof is opened and may be formed to be covered by the outdoor heat exchanger 223.

A plurality of grid-shaped grilles formed of a wire material may be disposed at the open rear surface of the rear plate 13. The outdoor heat exchanger 223 may also be exposed at the rear and configured to form a portion of an exterior of the rear surface of the outdoor unit 1, such as illustrated in FIG. 2.

In addition, an inner space of the outdoor unit 1 may be divided into the heat exchange space 22 and the mechanical room 21 by a barrier 20. The outdoor heat exchanger 223 and the blower fan 222, etc. may be disposed in the heat exchange space 22, and a compressor 211, valves, control box, etc., may be provided in the mechanical room 21. The outdoor heat exchanger 223 and the compressor 211 may be fixedly mounted on the base pan 11.

The outdoor heat exchanger 223 may be provided at a rear end of the base pan 11. The outdoor heat exchanger 223 may extend along an area of a rear end portion of the heat exchange space 22. The outdoor heat exchanger 223 include a plurality of heat transfer fins through which a plurality of refrigerant tubes pass. The outdoor heat exchanger 223 may be formed in a quadrilateral shape when viewed from the rear, but is not limited to any particular shape. The outdoor heat exchanger 223 may form a surface of the heat exchange space 22, and may be sized to cover the opened portion of the rear plate 13.

Consequently, all of the air suctioned into the outdoor unit 1 passes through the outdoor heat exchanger 223, making it possible for a heat exchange with the refrigerant passing through the inner portion of the outdoor heat exchanger 223.

The fan motor 221 may be provided in the outdoor unit 1. The fan motor 221 enables the blower fan 222 to rotate, and may be fixedly mounted on the motor mounting unit 121 formed at an inner surface of the front plate 12. In other words, the fan motor 221 may have a structure that is fixed directly to the front plate 12 by a separate coupling member, such as a screw or a bolt.

In addition, the blower fan 222 may be coupled to a rotation shaft of the fan motor 221. The blower fan 222 may be a centrifugal fan that suctions in air in the axial direction to discharge the air in the circumferential direction. The blower fan 222 may also be a plenum fan that does not require a housing.

For example, the blower fan 222 may have a disk-shaped central portion. The blower fan 222 may include a base 222*a* and a shroud 222*b* spaced apart from each other, and a plurality of blades 222*c* provided between the base 222*a* and the shroud 222*b*.

The base 222*a* may have a central portion formed in a protruding disk shape and may be coupled to the rotation shaft of the fan motor 221. The shroud 222*b* may be provided at the front spaced apart from the base 222*a* and may have an outer diameter corresponding to the base 222*a*. The central portion of the shroud 222*b* may be open to function as an air suction passage and may be formed having a curvature that curves toward the front progressively from the outside to the inside of the shroud 22*b*. The plurality of blades 222*c* may be radially disposed between the base 222*a* and the shroud 222*b*, and the blades 222*c* may be formed in a shape having a predetermined curvature.

An orifice member 30 may be formed in front of the blower fan 222. Specifically, the orifice member 30 may be formed between the blower fan 222 and the outdoor heat exchanger 223. The orifice member 30 allows the suctioned air to be introduced into the blower fan 222 via the entire surface of the outdoor heat exchanger 223. The orifice member 30 may be formed in the shape of a quadrilateral plate and mounted inside the heat exchange space 22, but is not limited to any particular shape.

Figure 4:
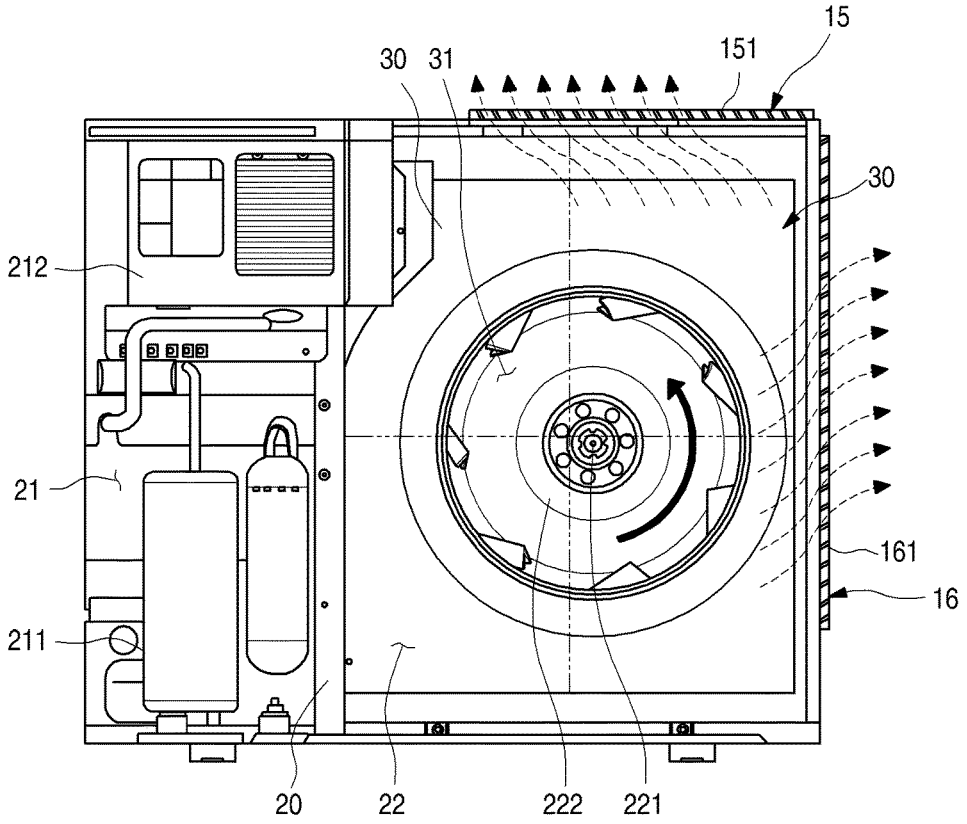
FIG. 4 is a view illustrating states of a blower fan and an orifice member installed inside the outdoor unit.
Figure 5:
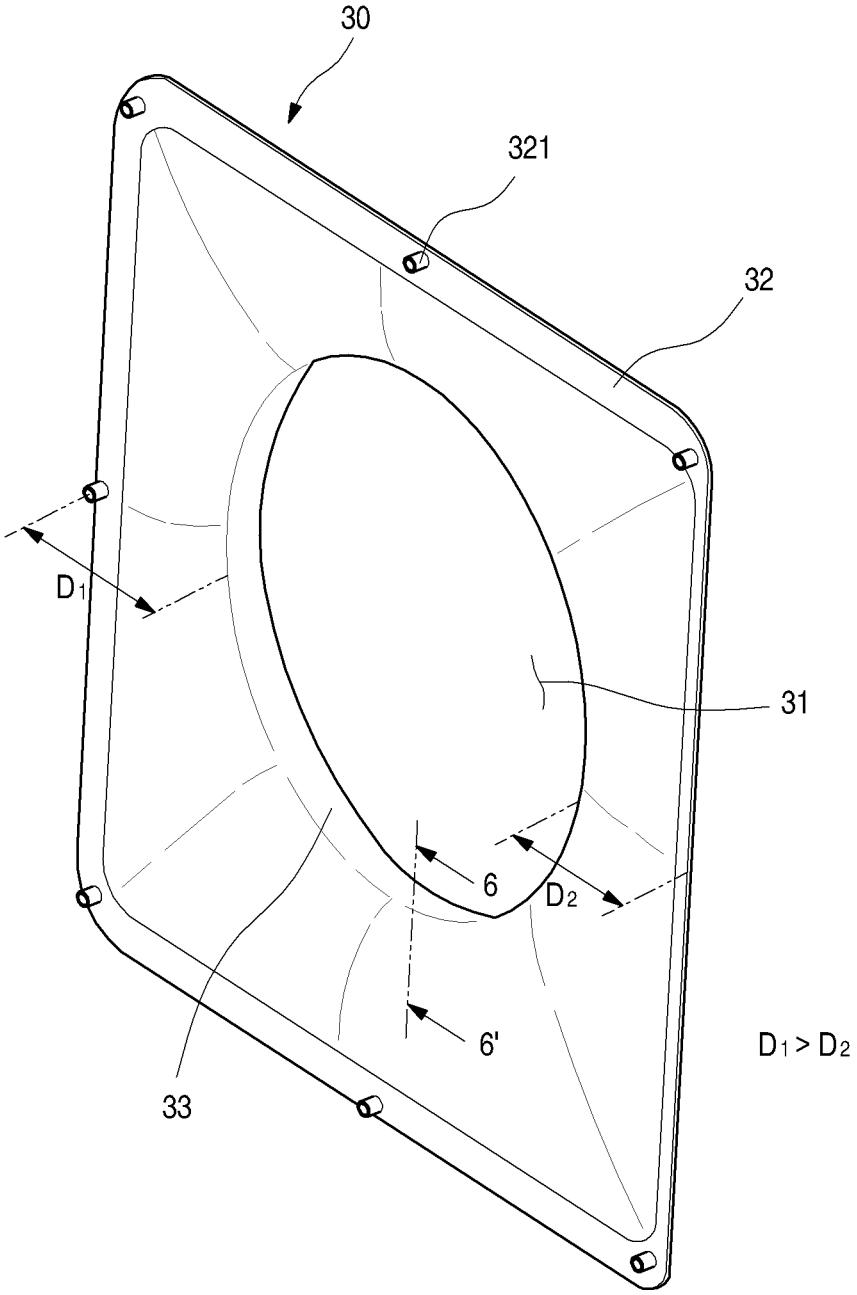
FIG. 5 is a perspective view of the orifice member.

FIG. 4 is a view illustrating mounted states of a blower fan 222 and an orifice member 30 inside the outdoor unit 1. Also, FIG. 5 is a perspective view of the orifice member 30. In addition, FIG. 6 is a cross-sectional view taken along line 6-6' of FIG. 5.

Figure 6:
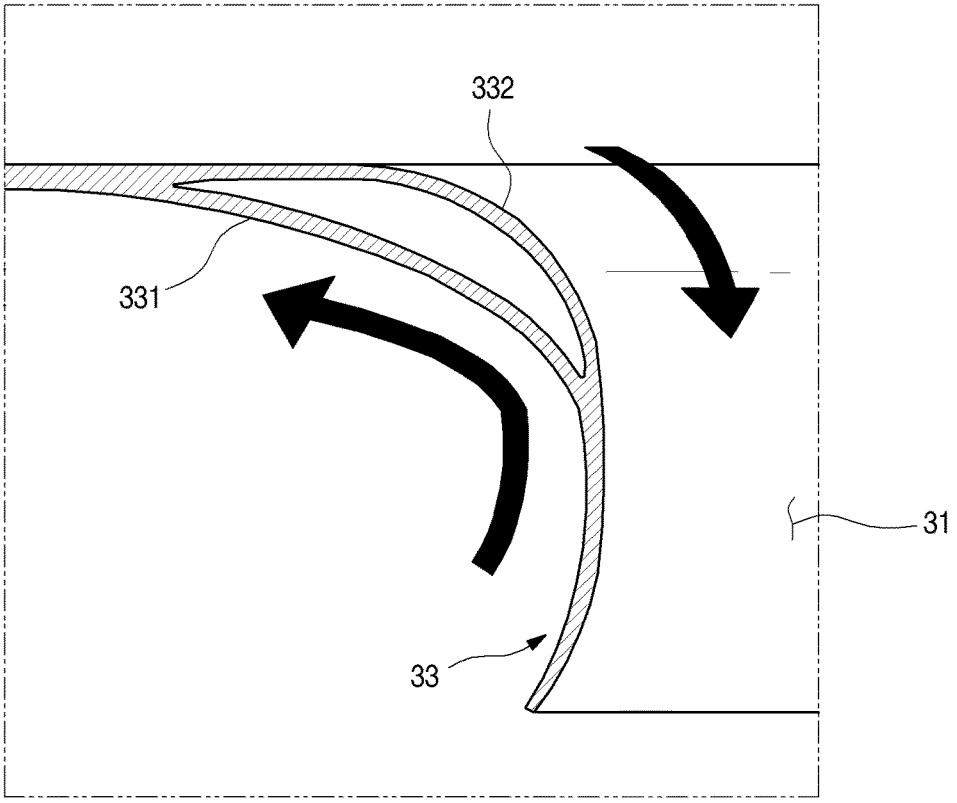
FIG. 6 is a cross-sectional view taken along line 6-6' of FIG. 5.

As illustrated in FIGS. 4-6, the orifice member 30 may be formed having a size corresponding to that of the outdoor heat exchanger 223, and may be formed to separate the heat exchange space 22 between the outdoor heat exchanger 223 and the blower fan 222. As shown, the orifice member 30 may be disposed in front of the front ends of the side discharge grille 16 and the top discharge grille 15. Consequently, the heat exchange space 22 may be separated along the front and rear directions into an area into which air is introduced and an area from which air is discharged.

Thus, according to the above-described structure, all of the air passing through the outdoor heat exchanger 223 may be introduced into the blower fan 222 via the orifice member 30 and discharged to the outside by the blower fan 222 via the side discharge grille 16 and the top discharge grille 15.

The orifice member 30 may also be configured to include a compartmentalizing unit 32 having a quadrilateral shape, an inlet 31 formed in the compartmentalizing unit 32, and a guide unit 33 that extends along the circumference of the inlet 31.

The compartmentalizing unit 32 may be formed in the shape of a quadrilateral plate to form an overall shape of the orifice member 30. A plurality of coupling units 321 may be formed along the circumference of the compartmentalizing unit 32. The coupling units 321 may be coupled to the inner surface of the case of the outdoor unit 1 to allow the orifice member 30 to be fixedly attached inside the outdoor unit 1.

The inlet 31 may be formed at the center of the compartmentalizing unit 32. The compartmentalizing unit 32 may be roundly or obliquely formed from the outside of the compartmentalizing unit 32 toward the inlet 31. Thus, the air suctioned through the circumferential portion of the outdoor unit 1 may be smoothly guided toward the inlet 31.

The inlet 31 may be formed to penetrate the compartmentalizing unit 32 and near the side discharge grille 16. The inlet 31 may be disposed at the center of the compartmentalizing unit 32 in a vertical direction but is disposed to be eccentric toward the side discharge grille 16 in a horizontal direction. In other words, for example, as shown in FIG. 5, a distance D2 from an outer end of the inlet 31 to an outer end of the compartmentalizing unit 32 abutting the side discharge grille 16 may be shorter than a distance D1 from the outer end of the inlet 31 to an outer end of the compartmentalizing unit 32 abutting the mechanical room 21.

The diameter of the inlet 31 may be less than that of the opening formed at the shroud 222*b* of the blower fan 222. Accordingly, the inlet 31 may be provided at an inner area of the opening of the shroud 222*b* when the orifice member 30 is mounted.

The guide unit 33 extending from the inlet 31 may be extended so as to be inserted into the opening of the shroud 222*b*. Consequently, air guided into the blower fan 222 by the guide unit 33 via the inlet 31 may be introduced entirely into the inner area of the blower fan 222 without being lost to the outside.

The guide unit 33 may facilitate suctioning and discharging flowing air by having an inner surface and an outer surface thereof formed with curved surfaces having predetermined curvatures. Specifically, for example, the first guide surface 332 that is the inner surface of the guide unit 33 guiding the air introduced through the inlet 31 may be roundly formed to have a predetermined curvature, and the second guide surface 331 that is the outer surface of the guide unit 33 guiding the air discharged by the blower fan 222 may be formed to have a gentler curvature than the first guide surface 332.

Accordingly, when the air suctioned through the inlet 31 is discharged through the blower fan 222, the air flows along a gentle slope of the second guide surface 331 and may be discharged through the side discharge grille 16 and the top discharge grille 15.

The center of the inlet 31 of the orifice member 30, the center of the blower fan 222, and the position of the rotation shaft of the fan motor 221 may be provided on the same extension line and may be provided at a position eccentric towards the side discharge grille 16 from a central portion of the heat exchange space 22.

Accordingly, when the air suctioned through the outdoor heat exchanger 223 is discharged by the blower fan 222 via the orifice member 30, the air may be smoothly discharged through the side discharge grille 16 and the top discharge grille 15, resulting in a more uniform air flow reduced noise.

Hereinafter, the air flow of the outdoor unit of the air conditioner according to the embodiment of the present disclosure having the above configuration will be described.

As illustrated in the drawings, the fan motor 221 may be driven in accordance with an operation of the outdoor unit 1 to rotate the blower fan 222.

The outside air may be introduced into the outdoor unit 1 from the rear of the outdoor unit 1 by the rotation of the blower fan 222. All of the air introduced into the outdoor unit 1 passes through the outdoor heat exchanger 223 and is heat-exchanged with the refrigerant flowing through the outdoor heat exchanger 223 while passing through the outdoor heat exchanger 223.

The heat-exchanged air may be guided to the center of the orifice member 30 by the compartmentalizing unit 32 of the orifice member 30, and may be introduced into the inner side of the blower fan 222 via the inlet 31 at the center of the orifice member 30. The air introduced into the blower fan 222 may be discharged in the circumferential direction of the blower fan 222 by a centrifugal force when the blower fan 222 rotates.

The air that has passed through the blower fan 222 may be discharged to the outside of the outdoor unit 1 by passing through the side discharge grille 16 and the top discharge grille 15 at a side portion and an upper portion of the outdoor unit 1.

Meanwhile, when the blower fan 222 rotates counter-clockwise, such as illustrated in FIG. 4, a plurality of grilles 161 forming the side discharge grille 16 may be obliquely formed to progressively head upward toward the outside of the outdoor unit 1. Consequently, the air discharged when the blower fan 222 rotates may be discharged to the outside of the outdoor unit 1 along angled outer surfaces of the grilles 161 while maintaining a direction in which the air flows.

In addition, a plurality of grilles 151 forming the top discharge grille 15 may be obliquely formed to become progressively farther from a direction adjacent to the side discharge grille 16 toward the top. Consequently, the air discharged when the blower fan 222 moves may be discharged to the outside of the outdoor unit 1 along angled outer surfaces of the grilles 151 while maintaining the direction in which the air flows.

Meanwhile, the top discharge grille 15 and the side discharge grille 16 may be provided at positions adjacent to each other and are formed about a corner of the circumference of the outdoor unit 1. Accordingly, the air discharged by the blower fan 222 may be discharged in sideward and upward directions through the top discharge grille 15 and the side discharge grille 16, respectively.

Figure 7:
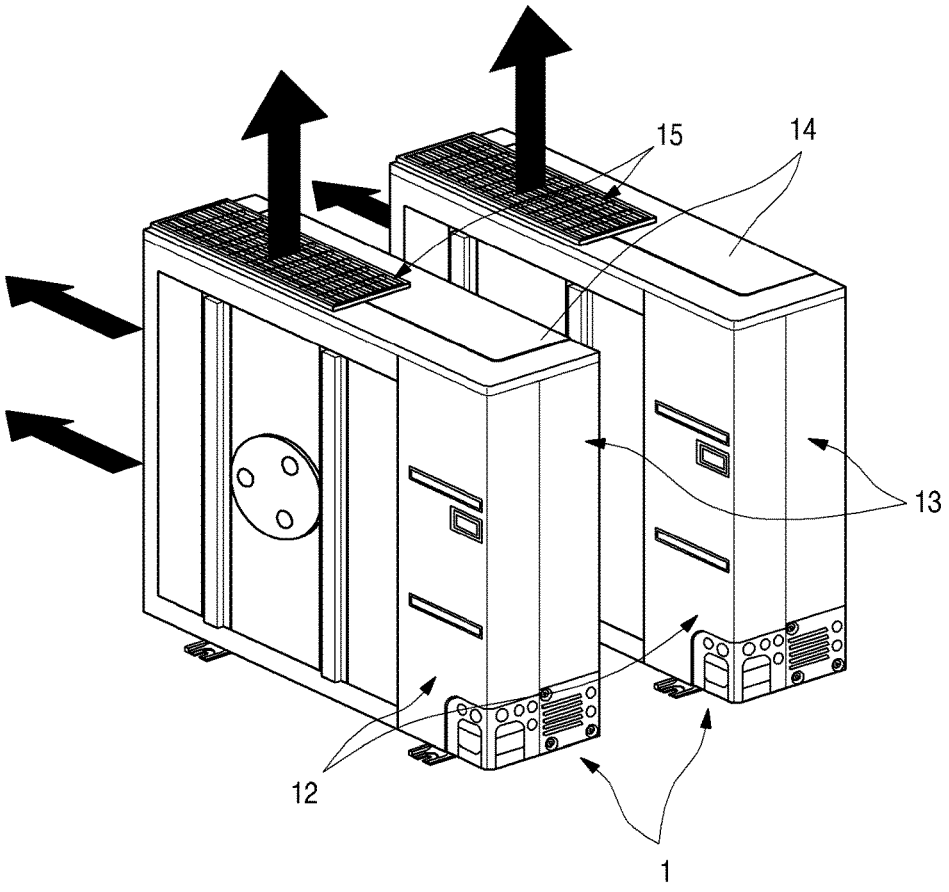
FIG. 7 is a view illustrating a state where the outdoor unit is disposed in a plurality.

FIG. 7 is a view illustrating a plurality of outdoor units.

As shown, a plurality of outdoor units 1 may be arranged in parallel. Thus, because air may be suctioned through one surface of a front surface or a rear surface of each of the outdoor units 1 in accordance with a direction in which each of the outdoor units 1 is arranged, the plurality of outdoor units 1 may be arranged parallel and adjacent to each other while maintaining a minimum interval through which the air may be suctioned.

The air being discharged may be discharged in an upward direction through the top covers 14 and the top discharge grilles 15 and may be discharged in a sideward direction through the side discharge grilles 16 at the side surfaces of the outdoor units 1.

Accordingly, the outdoor units 1 may be installed so as to minimize an installation space of the outdoor units 1. The space required for installation may be minimized when the outdoor units 1 are connected in parallel, and the outdoor units 1 facilitate the suctioning the outside air and the discharging the heat-exchanged air.

Figure 8:
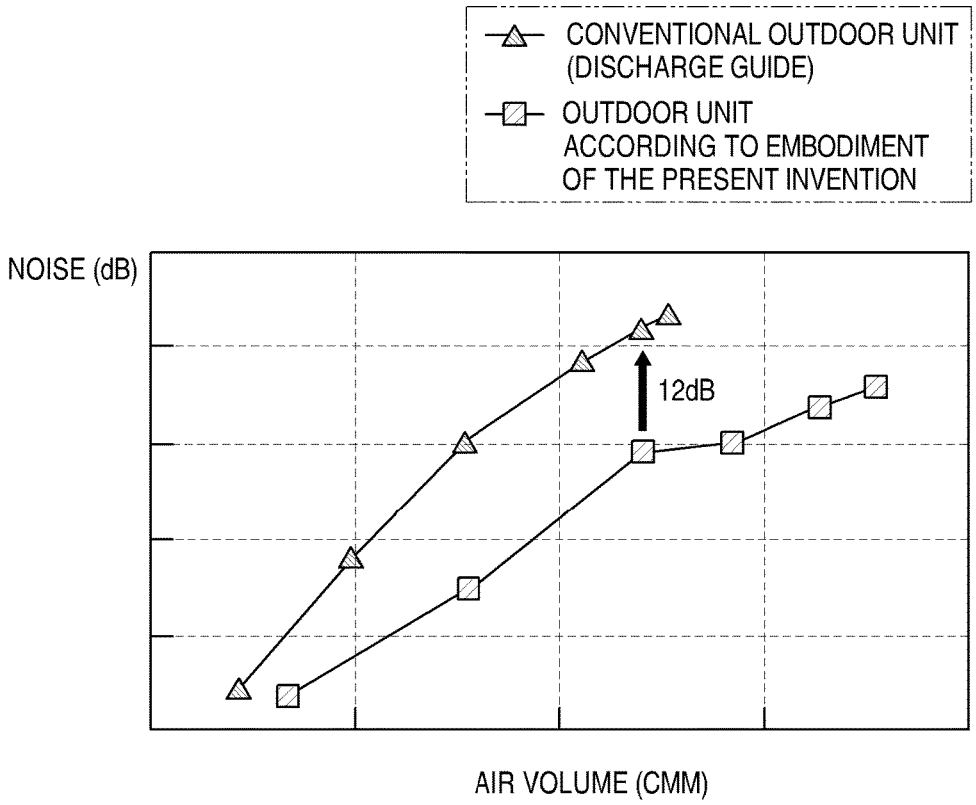
FIG. 8 is a graph comparing noise and air volume of the outdoor unit and an outdoor unit of an air conditioner having a discharge guide according to the conventional art.

FIG. 8 is a graph comparing noise and air volume of the outdoor unit and an outdoor unit of an air conditioner having a discharge guide according to a conventional configuration.

As shown, an air volume discharged by the outdoor unit 1 according to the embodiment of the present disclosure is greater than an air volume of air discharged by a conventional outdoor unit having an outlet formed at a front surface of the outdoor unit facing an inlet and an air guide disposed at the outlet to guide the discharged air to flow upward. Additionally, it is understood that when the air volumes are the same, a level of noise for an embodiment of the present disclosure is lower than that for the conventional structure having the air guide. Consequently, an improvement in the heat exchange efficiency by the air volume increase and the noise reduction by the smooth air flow according to the embodiment of the present disclosure.

According to an outdoor unit of an air conditioner according to an embodiment of the present disclosure, air is suctioned through one of a front surface and a rear surface of the outdoor unit, and air being discharged may be discharged through an upper surface of the outdoor unit or a side surface abutting the upper surface, thereby preventing heat-exchanged air from heading toward pedestrians when installed outdoors.

Additionally, regarding an embodiment of the present disclosure, an introduction of suctioned air is unaffected when the outdoor units are arranged in parallel, thereby not only allowing installation space of the outdoor units to be reduced but also allowing the outdoor units to be freely arranged.

Additionally, regarding an embodiment of the present disclosure, discharge grilles of the outdoor unit may be obliquely disposed in a direction of air being discharged, thereby preventing a vortex when the air is being discharged and preventing a noise increase due to the vortex.

Additionally, regarding an embodiment of the present disclosure, a blower fan mounted on the outdoor unit and a center of an orifice member that guides an introduction of air into the blower fan are eccentrically disposed from the center of a heat exchange space to be closer to a direction where the discharge grilles are disposed to allow the suctioned air to be discharged after naturally flowing to the discharge grilles, thereby reducing noise.

Additionally, regarding an embodiment of the present disclosure, air may be evenly suctioned throughout the heat exchanger as the positions of the blower fan and the orifice member are eccentric, thereby an improvement in the heat exchange efficiency may be expected.

Additionally, regarding an embodiment of the present disclosure, a curvature of a discharge side of the orifice member is less than that of a suction side of the orifice member to facilitate a discharge of suctioned air, thereby a further reduction in noise may be expected.

Although the preferred embodiments of the present disclosure have been disclosed for illustrative purposes, those skilled in the art will appreciate that various modifications, additions and substitutions are possible, without departing from the scope and spirit of the disclosure as disclosed in the accompanying claims.

What is claimed is:

1. An outdoor unit of an air conditioner, the outdoor unit comprising:

a case having a mechanical room and a heat exchange space, the case having a front surface, a rear surface, and a circumferential surface disposed between the front and rear surfaces;

a blower fan disposed in the heat exchange space to suction in air in an axial direction and discharge the suctioned air in a circumferential direction;

an outdoor heat exchanger disposed covering an opening formed in the rear surface, the outdoor heat exchanger providing a heat exchange between the suctioned air and a refrigerant;

a plurality of discharge grilles formed at a portion of the circumferential surface, the discharge grilles having a plurality of outlets to discharge the heat-exchanged air in the circumferential direction; and an orifice member that separates the blower fan and the outdoor heat exchanger, wherein the orifice member guides air that passes through the outdoor heat exchanger toward the blower fan and simultaneously guides the air discharged by the blower fan toward the plurality of outlets, wherein the outdoor unit further comprises a fan motor is attached to a front plate that forms the front surface.

2. The outdoor unit of claim 1, wherein the plurality of discharge grilles comprise:

a top discharge grille provided at an upper surface of the case; and a side discharge grille provided at a side of the circumferential surface, the side of the circumferential surface being in contact with the upper surface.

3. The outdoor unit of claim 1, wherein the plurality of discharge grilles are formed at a portion of the circumferential surface that includes an upper surface of the case.

4. The outdoor unit of claim 3, wherein the side of the circumferential surface is disposed perpendicular with the upper surface.

5. The outdoor unit of claim 2, wherein the top discharge grille contacts the side discharge grille.

6. The outdoor unit of claim 2, wherein the side discharge grille is disposed at a surface of the case that faces the mechanical room.

7. The outdoor unit of claim 2, wherein each of the top discharge grille and the side discharge grille comprises a plurality of grilles, each of the plurality of grilles being obliquely formed in directions crossing each other.

8. The outdoor unit of claim 1, wherein the plurality of discharge grilles comprise a plurality of grilles obliquely formed in the same direction as the rotational direction of the blower fan, the plurality of grilles being spaced apart from each other in equal intervals.

9. The outdoor unit of claim 1, wherein the front plate comprises reinforcement members disposed at opposite sides of the front plate with respect to the fan motor, the reinforcement members extending from one end of the front plate to another end of the front plate that faces the one end.

10. An outdoor unit of an air conditioner, the outdoor unit comprising:

a case having a mechanical room and a heat exchange space, the case having a front surface, a rear surface, and a circumferential surface disposed between the front and rear surfaces;

a blower fan disposed in the heat exchange space to suction in air in an axial direction and discharge the suctioned air in a circumferential direction;

an outdoor heat exchanger disposed covering an opening formed in the rear surface, the outdoor heat exchanger providing a heat exchange between the suctioned air and a refrigerant;

a plurality of discharge grilles formed at a portion of the circumferential surface, the plurality of discharge grilles having a plurality of outlets to discharge the heat-exchanged air in the circumferential direction; and an orifice member that separates the blower fan and the outdoor heat exchanger, wherein the orifice member guides air that passes through the outdoor heat exchanger toward the blower fan and simultaneously guides the air discharged by the blower fan toward the plurality of outlets, wherein the orifice member comprises:

a compartmentalizing unit that divides the heat exchange space;

an inlet formed in the compartmentalizing unit; and a guide unit that extends along a circumference of the inlet, wherein the inlet and the center of the blower fan are eccentrically disposed toward the plurality of discharge grilles inside the heat exchange space.

11. An outdoor unit of an air conditioner, the outdoor unit comprising:

a case having a mechanical room and a heat exchange space, the case having a front surface, a rear surface, and a circumferential surface disposed between the front and rear surfaces;

a blower fan disposed in the heat exchange space to suction in air in an axial direction and discharge the suctioned air in a circumferential direction;

an outdoor heat exchanger disposed covering an opening formed in the rear surface, the outdoor heat exchanger providing a heat exchange between the suctioned air and a refrigerant;

a plurality of discharge grilles formed at a portion of the circumferential surface, the plurality of discharge grilles having a plurality of outlets to discharge the heat-exchanged air in the circumferential direction; and an orifice member that separates the blower fan and the outdoor heat exchanger, wherein the orifice member guides air that passes through the outdoor heat exchanger toward the blower fan and simultaneously guides the air discharged by the blower fan toward the plurality of outlets, wherein the orifice member comprises:

a compartmentalizing unit that divides the heat exchange space;

an inlet formed in the compartmentalizing unit; and a guide unit that extends along a circumference of the inlet, wherein the compartmentalizing unit is rounded from an edge of the compartmentalizing unit toward the inlet.

12. An outdoor unit of an air conditioner, the outdoor unit comprising:

a case having a mechanical room and a heat exchange space, the case having a front surface, a rear surface, and a circumferential surface disposed between the front and rear surfaces;

a blower fan disposed in the heat exchange space to suction in air in an axial direction and discharge the suctioned air in a circumferential direction;

an outdoor heat exchanger disposed covering an opening formed in the rear surface, the outdoor heat exchanger providing a heat exchange between the suctioned air and a refrigerant;

a plurality of discharge grilles formed at a portion of the circumferential surface, the plurality of discharge grilles having a plurality of outlets to discharge the heat-exchanged air in the circumferential direction; and an orifice member that separates the blower fan and the outdoor heat exchanger, wherein the orifice member guides air that passes through the outdoor heat exchanger toward the blower fan and simultaneously guides the air discharged by the blower fan toward the plurality of outlets, wherein the orifice member comprises:

a compartmentalizing unit that divides the heat exchange space;

an inlet formed in the compartmentalizing unit; and a guide unit that extends along a circumference of the inlet, wherein the guide unit is inserted into an opening formed at a back surface of the blower fan.

13. The outdoor unit of claim 12, wherein the guide unit comprises an inner surface that guides inflowing air and an outer surface that guides the discharged air, the inner surface and the outer surface having different curvatures.

14. The outdoor unit of claim 12, wherein the guide unit comprises:

a first guide surface that forms an inner circumferential surface of the guide unit, the first guide surface being rounded with a predetermined curvature; and a second guide surface that forms an outer circumferential surface of the guide unit, the second guide surface having a curvature that is less than the predetermined curvature of the first guide surface.

15. The outdoor unit of claim 12, wherein an outer end of the compartmentalizing unit is disposed closer to the outdoor heat exchanger than to the discharge grilles.

16. The outdoor unit of claim 12, wherein an outer end of the orifice member separates the heat exchange space into a first area into which air is introduced and a second area from which air is discharged.

17. An outdoor unit of an air conditioner, the outdoor unit comprising:

a case having a mechanical room and a heat exchange space, the case having an upper surface, a front surface, a rear surface, and a circumferential surface disposed between the front and rear surfaces;

a blower fan disposed in the heat exchange space to suction in air in an axial direction and discharge the suctioned air in a circumferential direction;

an outdoor heat exchanger disposed covering an opening formed in the rear surface, the outdoor heat exchanger providing a heat exchange between the suctioned air and a refrigerant;

a plurality of discharge grilles formed at a portion of the circumferential surface, the plurality of discharge grilles having a plurality of outlets to discharge the heat-exchanged air in the circumferential direction; and an orifice member that separates the blower fan and the outdoor heat exchanger, wherein the orifice member guides air that passes through the outdoor heat exchanger toward the blower fan and simultaneously guides the air discharged by the blower fan toward the plurality of outlets, wherein the orifice member comprises:

a compartmentalizing unit that divides the heat exchange space;

an inlet formed in the compartmentalizing unit; and a guide unit that extends along a circumference of the inlet, wherein the plurality of discharge grills comprise a top discharge grill provided at the upper surface and a side discharge grille provided at a side of the circumferential surface that is in contact with the upper surface, wherein a distance from an outer edge of the inlet to an outer edge of the compartmentalizing unit that contacts the side discharge grill is less than a distance from an outer edge of the inlet to an outer end of the compartmentalizing unit that contacts the mechanical room.

* * * * *